US009549655B2

(12) United States Patent
Milanese et al.

(10) Patent No.: US 9,549,655 B2
(45) Date of Patent: Jan. 24, 2017

(54) HOT CLEANING SYSTEM FOR SURFACES

(71) Applicant: Pier Antonio Milanese, Susegana (IT)

(72) Inventors: Pier Antonio Milanese, Susegana (IT); Andrea Milanese, Conegliano (IT)

( * ) Notice: Subject to any disclaimer, the term of this patent is extended or adjusted under 35 U.S.C. 154(b) by 169 days.

(21) Appl. No.: 14/510,258

(22) Filed: Oct. 9, 2014

(65) Prior Publication Data

US 2015/0033483 A1 Feb. 5, 2015

Related U.S. Application Data

(63) Continuation-in-part of application No. 14/129,412, filed as application No. PCT/IT2013/000152 on May 30, 2013.

(30) Foreign Application Priority Data

May 31, 2012 (IT) ..... TV2-12A0106

(51) Int. Cl.

| | |
|---|---|
| ***A47L 13/16*** | (2006.01) |
| ***A47L 11/34*** | (2006.01) |
| ***A47L 13/12*** | (2006.01) |
| ***A47L 13/26*** | (2006.01) |
| ***A46B 11/00*** | (2006.01) |
| ***A47L 11/40*** | (2006.01) |

(52) U.S. Cl.

CPC ..... *A47L 13/16* (2013.01); *A46B 11/002* (2013.01); *A46B 11/0006* (2013.01); *A47L 11/34* (2013.01); *A47L 11/408* (2013.01); *A47L 13/12* (2013.01); *A47L 13/26* (2013.01)

(58) Field of Classification Search

CPC ..... A47L 13/17; A47L 13/22; A47L 13/225; A47L 13/32; A47L 11/4086

USPC ..... 401/1, 2

See application file for complete search history.

(56) References Cited

U.S. PATENT DOCUMENTS 1,938,811 A * 12/1933 Cook ..... A47L 13/32 118/202
1,969,036 A * 8/1934 Riebel, Jr. ..... A47L 13/32 192/99 A
2,089,911 A * 8/1937 Replogle ..... A47L 13/32 15/320

(Continued)

FOREIGN PATENT DOCUMENTS

EP 0842631 A1 5/1998
EP 1795109 A2 6/2007

*Primary Examiner* — Jennifer C Chiang
*Assistant Examiner* — Bradley Oliver
(74) *Attorney, Agent, or Firm* — Frank Marino

(57) ABSTRACT

An apparatus for the hot and moist cleaning of floors is disclosed, having an elongate body including a handle at a proximal end thereof and a water reservoir; and a cleaning head flexibly disposed at a distal end of the elongate body and having a heating plate and a cleaning pad, wherein the heating plate forms a planar underside of the cleaning head and includes a heating element to heat the planar underside. The water reservoir is adapted to moisten the cleaning pad when the planar underside is above 85 C. The cleaning pad is removably attached against and in thermal communication with the planar underside such that the cleaning pad is moistened and heated to a temperature between 85 C and 100 C, inclusive. And the heating plate does not substantially heat water from the water reservoir prior to the moistening of the cleaning pad.

16 Claims, 11 Drawing Sheets

(56) References Cited

U.S. PATENT DOCUMENTS 2,865,037 A * 12/1958 King ..... A47L 13/32 15/231
3,822,434 A * 7/1974 Mahoney ..... A45D 27/04 15/160
4,312,598 A * 1/1982 Vagner ..... A47L 13/26 401/1
5,587,021 A 12/1996 Hoersch
5,920,952 A 7/1999 Baldacci
6,289,551 B1 9/2001 Basile
6,584,990 B2 * 7/2003 Shaw ..... A47L 13/225 134/105
7,266,292 B1 * 9/2007 Tsai ..... A47L 11/34 15/320
7,380,307 B2 6/2008 Tsai
7,930,798 B2 4/2011 Zhou et al.
8,171,592 B2 5/2012 Tsai
8,205,293 B2 6/2012 Rosenzweig et al.
8,353,074 B2 1/2013 Krebs
8,534,301 B2 9/2013 Nottingham et al.
2003/0027473 A1 * 2/2003 Kakiuchi ..... A47L 13/17 442/121
2003/0045197 A1 * 3/2003 Kakiuchi ..... A47L 13/17 442/403
2003/0115711 A1 * 6/2003 Rosa ..... A47L 11/34 15/320
2004/0031506 A1 2/2004 Tsai
2004/0163199 A1 * 8/2004 Hsu ..... A47L 11/34 15/320
2007/0077810 A1 * 4/2007 Gogel ..... H01R 13/60 439/505
2007/0209139 A1 9/2007 Carlucci et al.
2008/0236635 A1 10/2008 Rosenzweig et al.
2009/0320231 A1 12/2009 Rosenzweig et al.
2010/0050367 A1 * 3/2010 Tsai ..... A47L 13/225 15/320
2010/0126533 A1 * 5/2010 Nottingham ..... A47L 13/22 134/105
2012/0145191 A1 * 6/2012 Williams ..... A47L 13/17 134/6
2012/0204376 A1 * 8/2012 Charlton ..... A47L 13/225 15/322
2013/0269135 A1 * 10/2013 Colangelo ..... A47L 13/16 15/209.1
2013/0291324 A1 * 11/2013 Suda ..... A47L 13/17 15/104.94
2013/0318725 A1 * 12/2013 Kellis ..... A47L 11/34 8/137
2013/0319463 A1 * 12/2013 Policicchio ..... A47L 13/225 134/6
2014/0165324 A1 * 6/2014 Luo ..... A47L 11/4086 15/320
2015/0305588 A1 * 10/2015 Dingert ..... A47L 13/22 15/320
2016/0106287 A1 * 4/2016 Hussey ..... B08B 3/026 15/320

* cited by examiner

HOT CLEANING SYSTEM FOR SURFACES

RELATED APPLICATIONS

This application is a Continuation-in-Part of U.S. application Ser. No. 14/129412, filed on 26 Dec. 2013, which is the U.S. National Stage of PCT/IT2013/000152 filed 30 May 2013, which claims the benefit of pending Italian Patent Application No. TV2012A000106 filed 31 May 2012, the entire teachings of which, for all, is incorporated herein by reference. This application is also a Continuation-in-Part of U.S. Provisional App. No. 61/951955, filed on 12 Mar. 2014, the entire teachings of which is incorporated herein by reference.

FIELD OF THE INVENTION

This patent concerns surface cleaning devices in general and in particular it refers to a system for the hot cleaning of surfaces provided with a heating device for the cloth in microfiber and/or other material suitable for surface cleaning installed on the support of the same cloth.

BACKGROUND

From EP 1795109 is known a steam generator comprising an external casing with an opening that enables the inner space to communicate with the space outside. Moreover, the steam generator can be equipped with a feeding element that supplies water to said inner space, with a heating element foreseen in the opening to generate steam, an exhaust pipe whose one end is connected to the outside space to discharge steam, and a means for the control of the steam discharge on the other end to open and close the pipe outlet depending on the presence or absence of the steam to be discharged.

From EP 0842631 A is known a steam-operated cleaning device comprising a boiler equipped with heating means, steam release means connected to said boiler, and a cleaning tool comprising a foot and a handle so that said boiler and said steam release means are positioned in said foot.

SUMMARY OF THE INVENTION

The purpose of this invention is that of creating a surface hot cleaning system having a different construction from the one disclosed by the state of the art, i.e. EP 1795109 A and EP 0842631 A. The special characteristics of the invention can be summed up in the following advantages:

- Cleaning and sanitising action guaranteed by the constant and high temperature of the cloth.
- Fast drying of the surface.
- No scale build-up and therefore unlimited duration.
- Remarkable energy saving—about one third of the installed power in comparison with any other steam device.
- Limited production costs, if compared to the existing systems.

The invention may be embodied by or practiced using an apparatus for the cleaning of surfaces, having a power cord detachable from the apparatus, a cleaning head having a heating plate, and a cleaning pad, wherein the heating plate forms a planar underside of the cleaning head and includes a heating element to heat the planar underside when the power cord energizes the heating element. The cleaning pad may be removably attached against and in thermal communication with the planar underside such that the cleaning pad is heated to a temperature between 85 C and 100 C, inclusive, when the power cord energizes the heating element. And the heating element may not heat the planar underside and the cleaning pad may not be heated whenever the power cord is detached from the apparatus. The cleaning pad may be a pre-moistened fabric pad.

This apparatus may further have a cleaning head including the heating plate and the cleaning pad, and an elongate body having a handle at a proximal end thereof, wherein the cleaning head may be flexibly disposed at a distal end of the elongate body.

The invention may alternatively be embodied by or practiced using an apparatus for the hot and moist cleaning of surfaces, having a water reservoir, and a cleaning head having a heating plate and a cleaning pad, wherein the heating plate forms a planar underside of the cleaning head and includes a heating element to heat the planar underside. The water reservoir may be adapted to moisten the cleaning pad when the planar underside is above approximately 85 C. The cleaning pad may be removably attached against and in thermal communication with the planar underside such that the cleaning pad is moistened and heated to a temperature between 85 C and 100 C, inclusive. And the heating plate may not substantially heat water from the water reservoir prior to the moistening of the cleaning pad.

This alternative apparatus may further have a thermally-actuated valve to control the moistening of the cleaning pad by the water reservoir. The thermally actuated valve may be configured to open at approximately 85 C or above to allow water from the water reservoir to the cleaning pad. The thermally actuated valve may have a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly.

This alternative apparatus may further have an elongate body including a handle at a proximal end thereof, wherein the cleaning head is flexibly disposed at a distal end of the elongate body. The water reservoir may be disposed on the elongate body above the cleaning head, and may be adapted to moisten the cleaning pad by gravitational force when the valve stem is in the open position.

This alternative apparatus may further have a thermostat electrically connected to the heating element and adapted for sensing the temperature of the planar underside to maintain the temperature of the cleaning pad between 85 C and 100 C, inclusive.

This alternative apparatus may further have a thermo-fuse electrically connected to the heating element and adapted for sensing the temperature of the planar underside to disable the apparatus when an abnormally high temperature is sensed.

Additionally, the invention may alternatively be embodied by or practiced using an apparatus for the hot and moist cleaning of floors having an elongate body including a handle at a proximal end thereof and a water reservoir; and a cleaning head flexibly disposed at a distal end of the elongate body and having a heating plate and a cleaning pad, wherein the heating plate forms a planar underside of the cleaning head and includes a heating element to heat the planar underside. The water reservoir may be adapted to moisten the cleaning pad when the planar underside is above 85 C. The cleaning pad may be removably attached against and in thermal communication with the planar underside such that the cleaning pad is moistened and heated to a temperature between 85 C and 100 C, inclusive. And the heating plate may not substantially heat water from the water reservoir prior to the moistening of the cleaning pad.

This additionally alternative apparatus may further have a thermally-actuated valve to control the moistening of the cleaning pad by the water reservoir. The thermally actuated valve may be configured to open at approximately 85 C or above to allow water from the water reservoir to the cleaning pad. The thermally actuated valve may have a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly. The water reservoir may be disposed on the elongate body above the cleaning head, and may be adapted to moisten the cleaning pad by gravitational force when the valve stem is in the open position.

This additionally alternative apparatus may further have a thermostat electrically connected to the heating element and adapted for sensing the temperature of the planar underside to maintain the temperature of the cleaning pad between 85 C and 100 C, inclusive.

This additionally alternative apparatus may further have a thermo-fuse electrically connected to the heating element and adapted for sensing the temperature of the planar underside to disable the apparatus when an abnormally high temperature is sensed. This additionally alternative apparatus may further have a trigger-actuated valve in fluid communication with the water reservoir and thermally-actuated valve to selectively allow or deny water from the water reservoir to the thermally-actuated valve.

Further features and aspects of the invention are disclosed with more specificity in the Detailed Description and Drawings provided herein and showing exemplary embodiments of the invention.

BRIEF DESCRIPTION OF THE DRAWINGS

As an explanation, without limitations, of the characteristics of this invention, an example of realisation of the system is now described with reference to the drawings enclosed:

FIG. 3 (ref. 11) shows the holes on the heating panel through which the water flows. FIG. 3 (ref 12) shows the thermostat for temperature regulation.

DETAILED DESCRIPTION OF EXEMPLARY EMBODIMENTS

Figure 1:
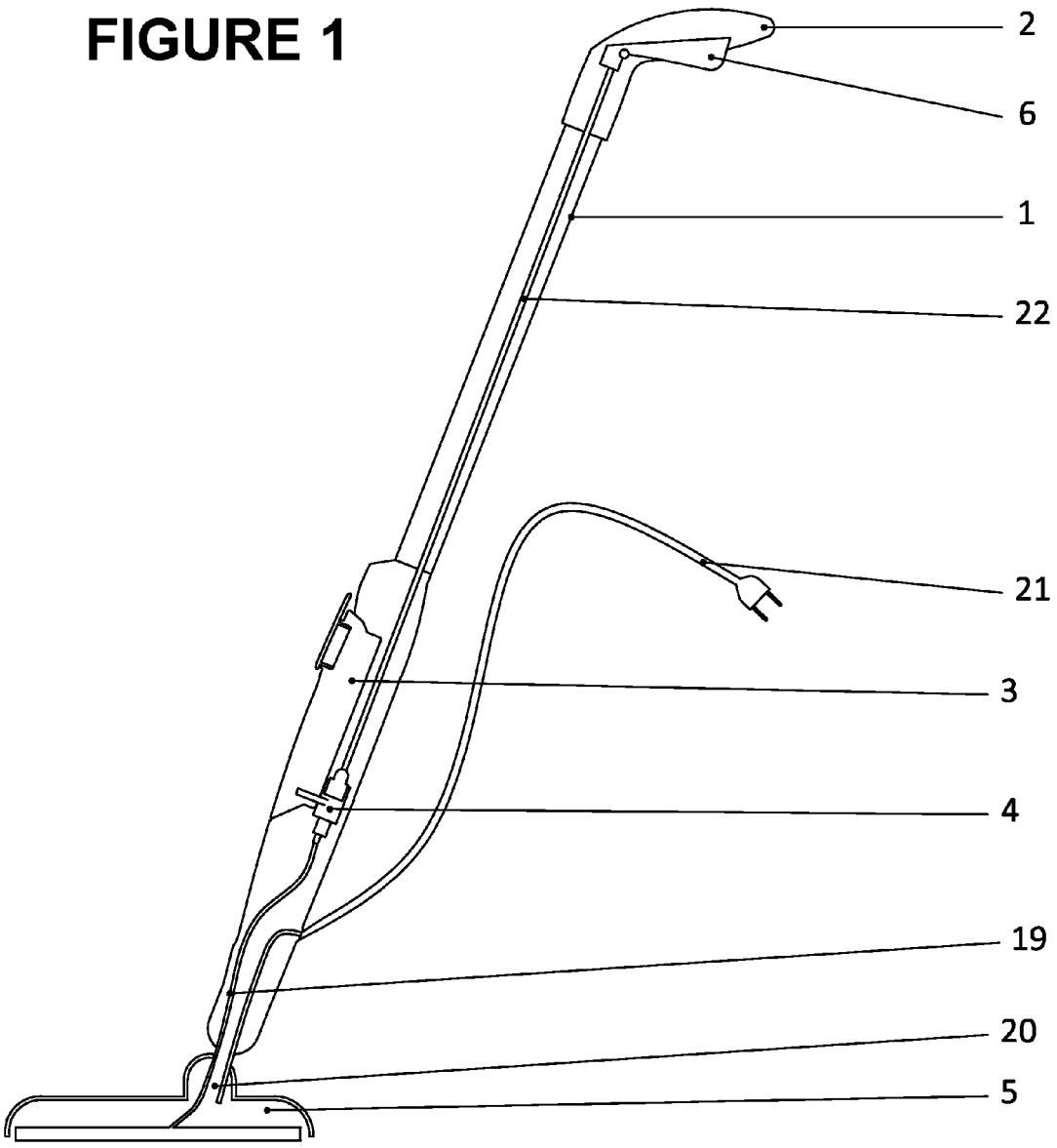
FIG. 1 shows a first exemplary embodiment according to the invention with the handle grip (1) provided with a handle (2), the water tank (3), the pump (4), the brush (5) comprising the water distribution chamber, the heating panel and the cleaning cloth.

FIGS. 1 though 4 show a first device having some of the features novel to the invention. From the tank (3) the water is sucked by means of a manual and/or electric pump (4) with pre-set suction quantity and then the water flows through a pipe (19) to the distribution chamber (7).

Said chamber is equipped with pipes for water flow and distribution (8), through the holes of the heating panel (11) to reach the cleaning cloth (16).

The heating panel consists of a metal element, preferably aluminium (9), which hosts a heating element (14). The panel is provided with holes for water flow (11). Said panel is equipped with a thermostat (12) suitably calibrated that keeps the heating panel temperature constant at the pre-set degree.

Figure 2:
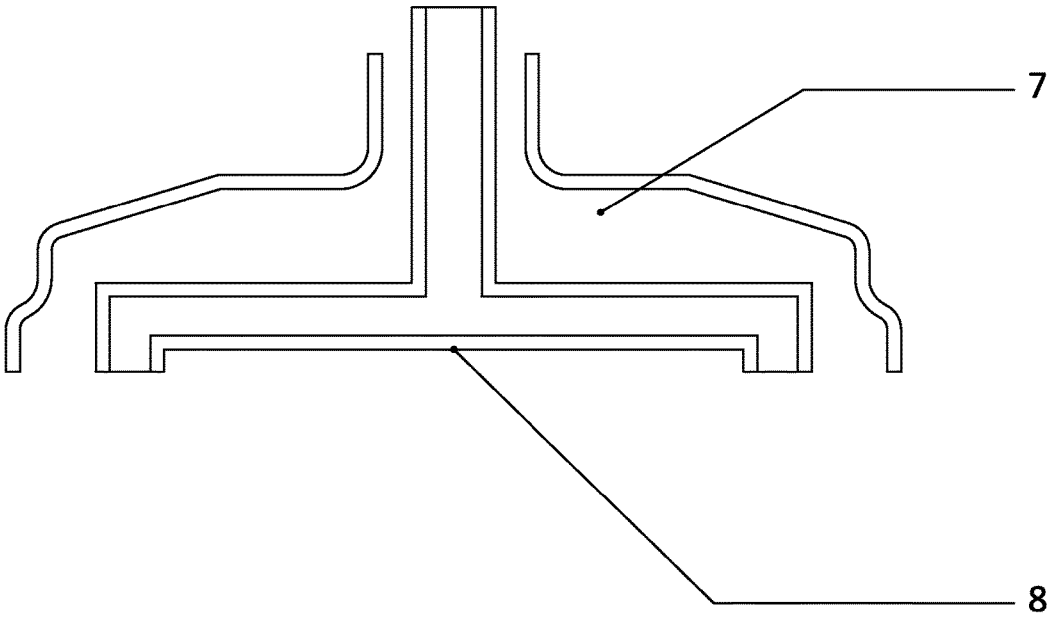
FIG. 2 (ref. 7) shows the section of the water distribution chamber of the first embodiment, FIG. 2 (ref. 8) shows the water pipes going into the same chamber.
Figure 3:
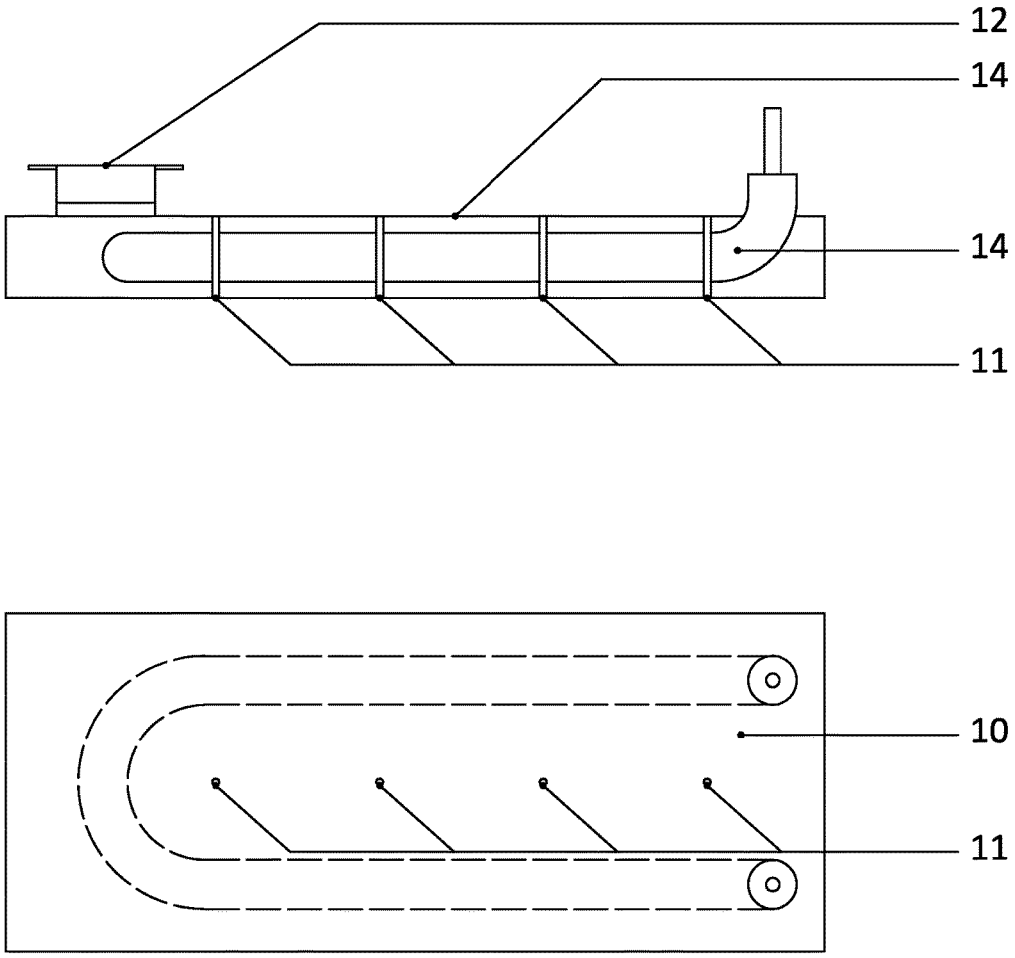
FIG. 3 shows the heating panel of the first embodiment in cross sectional view and from above. The heating panel (9) hosts the heating element (14).
Figure 4:
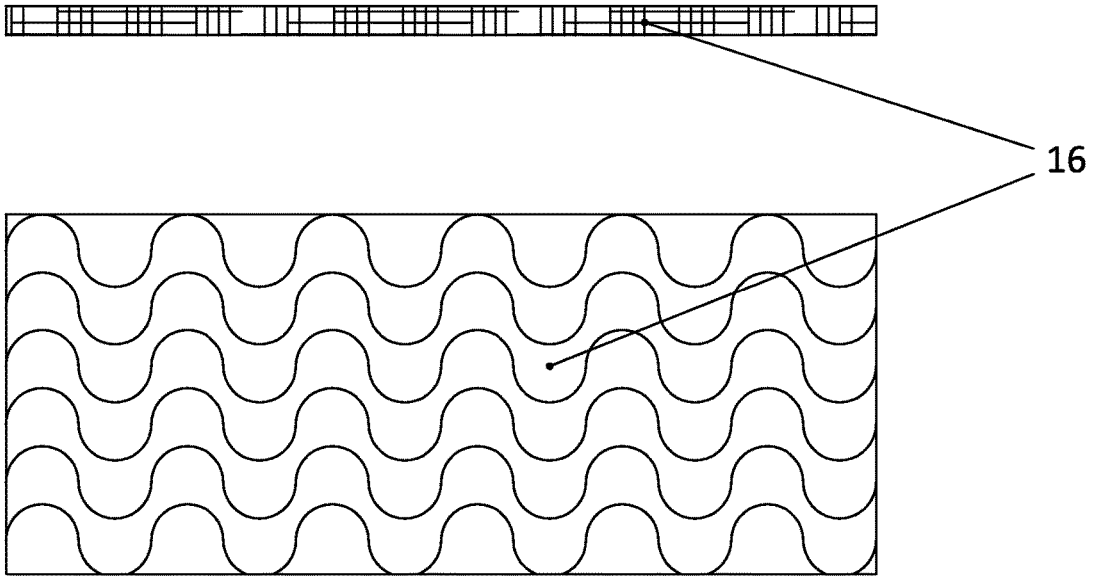
FIG. 4 (ref. 16) shows the cleaning cloth of the first embodiment in cross sectional view and from above.

The water quantity is regulated by a manual and/or electric pump (4) controlled by the lever of the handle grip (6) by means of a connection element between the lever and the pump (22) and the water flows in through a pipe (19) and gets into the distribution chamber (FIG. 2). Said chamber is provided with pipes (8) suitable to make the water flow through the holes of the heating panel (11) to the cleaning cloth (FIG. 4).

The cleaning cloth (FIG. 4) is in direct contact with the entire lower surface of the heating panel (10), which warms it up to the pre-set temperature by means of the thermostat (12) positioned on the heating panel.

Since the entire surface of the cleaning cloth is in direct contact with the heating panel, the cloth gets to a very high temperature around 100° C. and the water coming from the holes on the heating panel moistens and goes through the cleaning cloth, thus acquiring the temperature of the same heating panel.

Thanks to this process, the cloth cleaning and sanitising action on the floor is extremely effective and homogeneous because it is carried out at a temperature around 100° C. kept constant by the heating panel provided with a thermostat that adjusts the temperature, whose action guarantees that even the most difficult dirt is removed as well as the sanitising action that eliminates germs and bacteria.

The total lack of scale build-up insures unlimited life to the device unlike all other steam systems that cannot be used after a short period of time because of scale build-up.

Energy saving amounts to about one third in comparison to any other device thanks to the fact that the entire surface of the cleaning cloth is warmed up, i.e. where it is actually necessary and there is no loss of heat, unlike the temperature produced by steam that cannot keep its temperature and therefore is less effective because it has to get through cold surfaces. The system production costs are limited because it consists of a few elements unlike any other device for steam generation, whose costs are much higher because of the great number of components and their assembly.

Referring now to FIGS. 5 through 18, a second exemplary embodiment is depicted in the form of a mopping apparatus 200 in which a cleaning pad 228 is moistened and heated to more effectively clean and sanitize a floor or other such surface.

Figure 5:
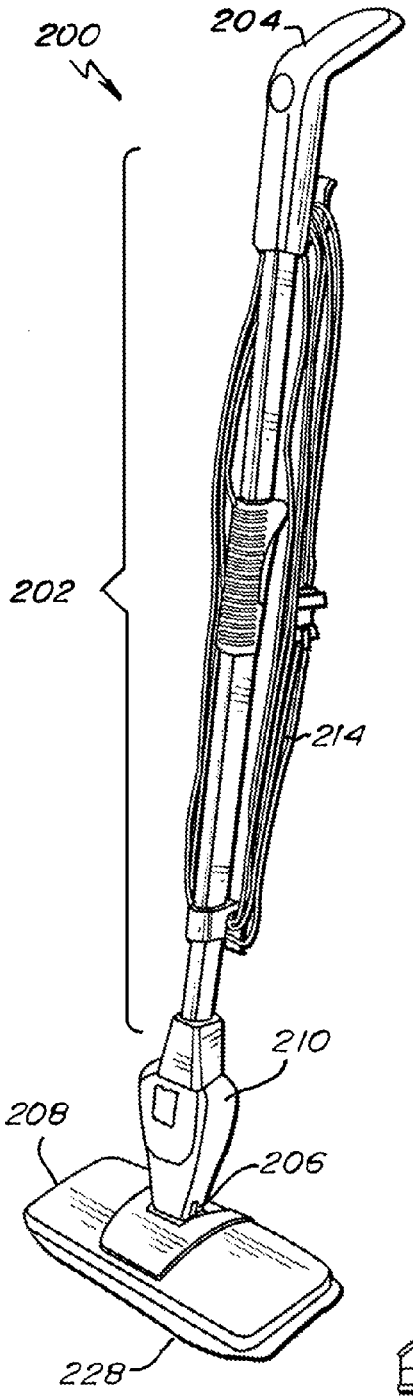
FIG. 5 shows a perspective view of a hot cleaning system according to a second exemplary embodiment of the invention.
Figure 6:
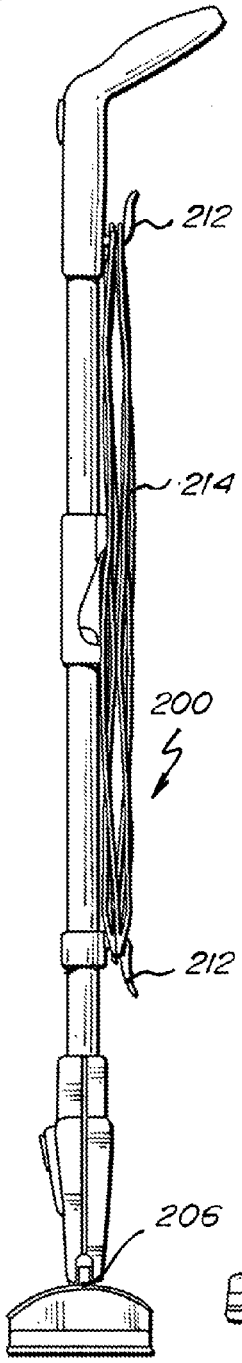
FIG. 6 shows a side view of the second embodiment.
Figure 7:
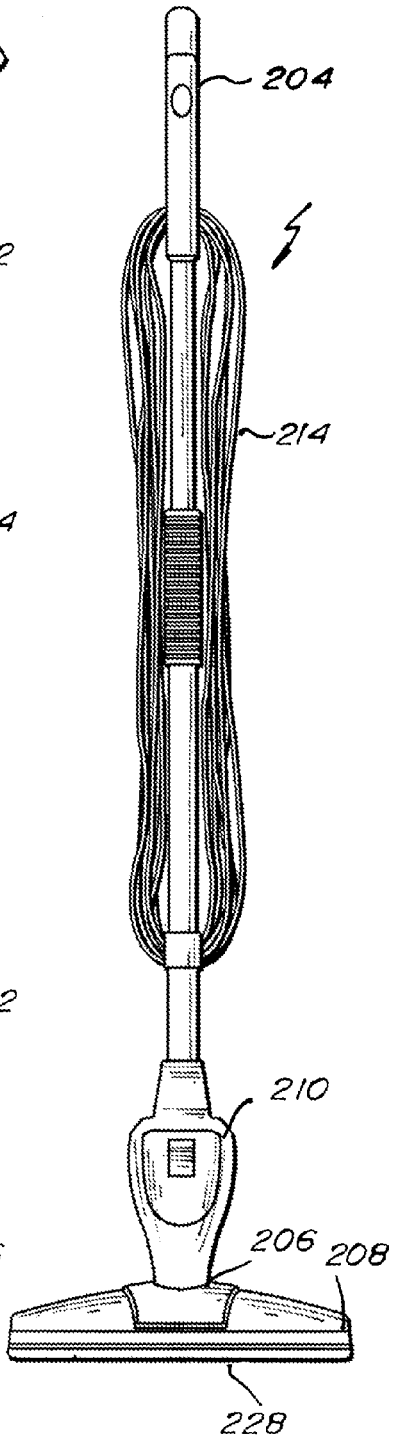
FIG. 7 shows a front view of the second embodiment.

FIGS. 5 through 7 show that the mop includes an elongate body 202 having a handle 204 at its proximal (top) end and a hinge 206 at its distal (bottom) end to which is hingedly connected a cleaning head 208. The elongate body also includes a refillable water reservoir 210 and hooks 212 for securing a power cord 214.

Figure 8:
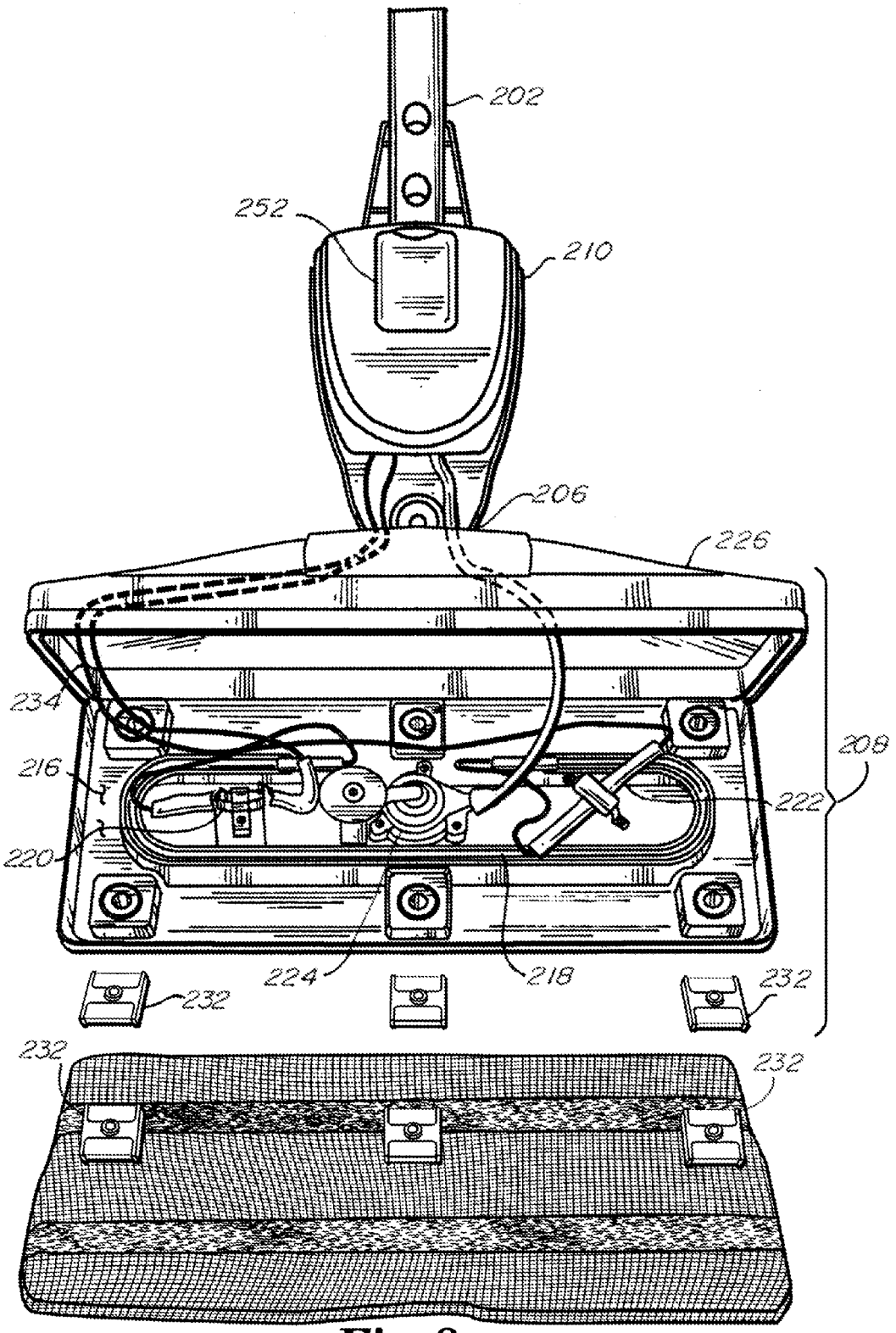
FIG. 8 shows a partially disassembled view of the head and tank portions of the second embodiment.
Figure 9:
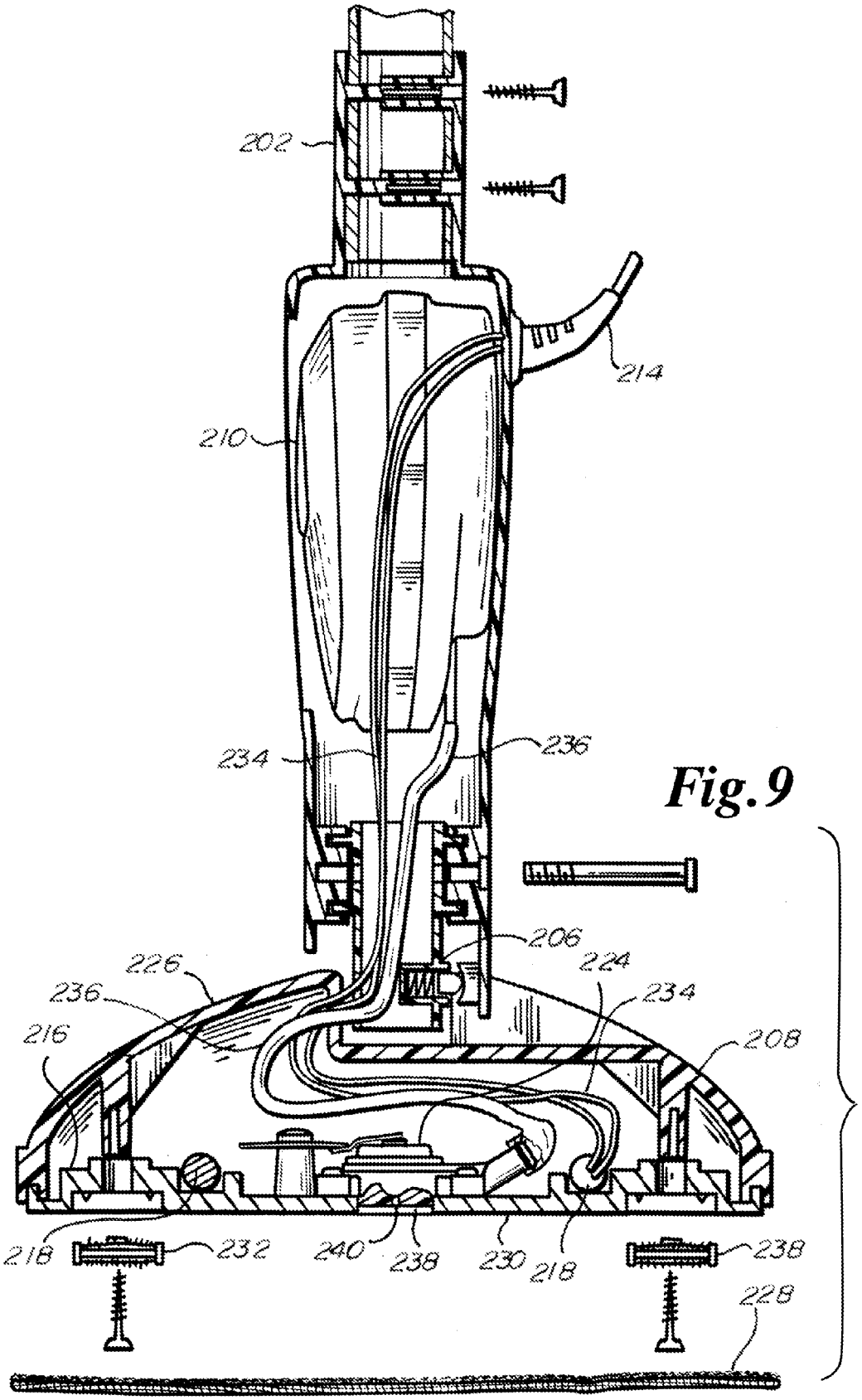
FIG. 9 shows a side cross section of the head and tank portions of the second embodiment.

Referring next to FIG. 8, where cleaning head 208 is shown exploded and partially disassembled to afford a clear view of its components, and to FIG. 9, where the lower portion of the mopping apparatus is shown in cross section, it can be seen that the head includes a heating plate 216, a heating element 218, a thermostat 220, a thermo-fuse 222, a thermal valve 224, a cover 226, and a cleaning pad 228 which removably affixes to and against the planar underside 230 of the heating plate by means of hook/loop fasteners 232. The cleaning pad is preferably made of cotton for its optimal absorbency, heat tolerance, and wash-ability.

The heating plate is made of metal, preferably a highly thermally conductive metal such as aluminium, and preferably made by die-casting and machining The heating element is preferably insert-cast into the heating plate to optimize heat transfer.

The configuration of the heating plate is such that heat from the heating element most efficiently conducts to the planar underside, and the thermostat and thermo-fuse most effectively monitor and react to the temperature of that flat underside. While water is selectively allowed to flow through the thermal valve and heating plate to moisten the cleaning pad, as will be later explained, the configuration of the heating plate is such that this water is not substantially heated and arrives at the cleaning pad at substantially its original temperature. This prevents scaling and mineral build-up that would otherwise cause blockages and require internal maintenance, especially for users in hard water areas. This also prevents the boiling of water within the heating plate which would otherwise cause the formation of steam and the adverse effects thereof, such as noise and spitting.

Electrical wires 234 facilitate the selective feeding of power from the power cord 214, through the hinge 206, thermostat 220, thermo-fuse 222, and to the heating element 218, when all of the thermostat, thermo-fuse, and an optional power switch (not shown) are electrically closed. The thermostat allows the heating element to continue heating the planar underside until it senses a temperature of 120 C, at which time it will open. It will close again once it senses a drop in the temperature to 90 C and will then continue to cycle on and off repeatedly to maintain the temperature between 90 C and 120 C. The thermo-fuse is a one-time safety device which will permanently open, disabling operation of the apparatus, if it senses an abnormally high temperature, indicating that the thermostat has failed. Preferable, the thermo-fuse will open at 170 C, requiring disposal or repair of the mopping apparatus.

Conduit tubing 236 provides a pathway for water from the water reservoir 210 to the thermal valve 224. The thermal valve is connected to a channel 238 on the planar underside 230 of heating plate which provides moisture to the cleaning pad. When the thermal valve is open, water is allowed to flow by gravity from the water reservoir to the channel to moisten the cleaning pad 228 affixed firmly and flatly there-against. The flow of water alternatively may be controlled by the addition of a trigger (not shown) at the handle to selectively actuate a supply valve to release water from the tank to the thermal valve. This trigger-actuated valve would be in fluid communication with the water reservoir and thermally-actuated valve to selectively allow or deny water from the water reservoir to the thermally-actuated valve. Or the water supply may alternatively be controlled by an electric pump in arrangements that cannot benefit adequately from the forces of gravity.

Figure 10:
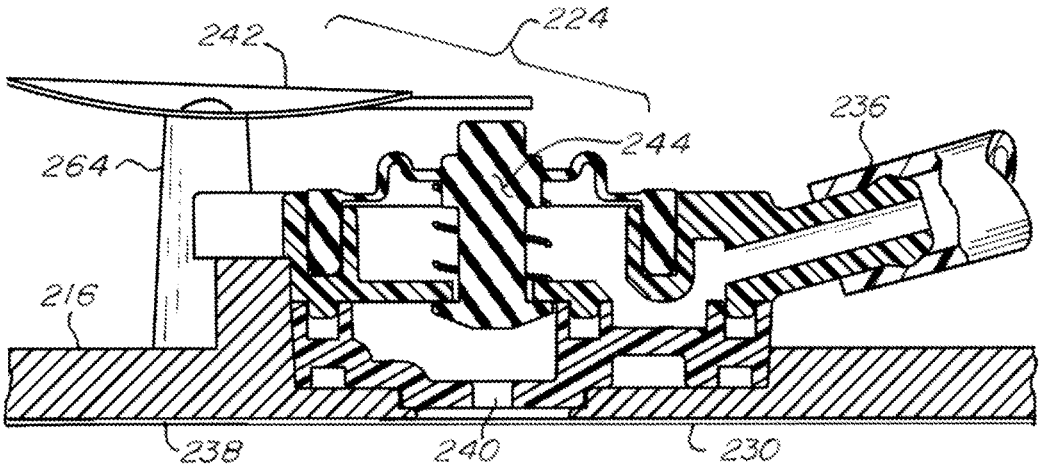
FIG. 10 shows a cross section of the thermal valve of the second embodiment in the closed position
Figure 11:
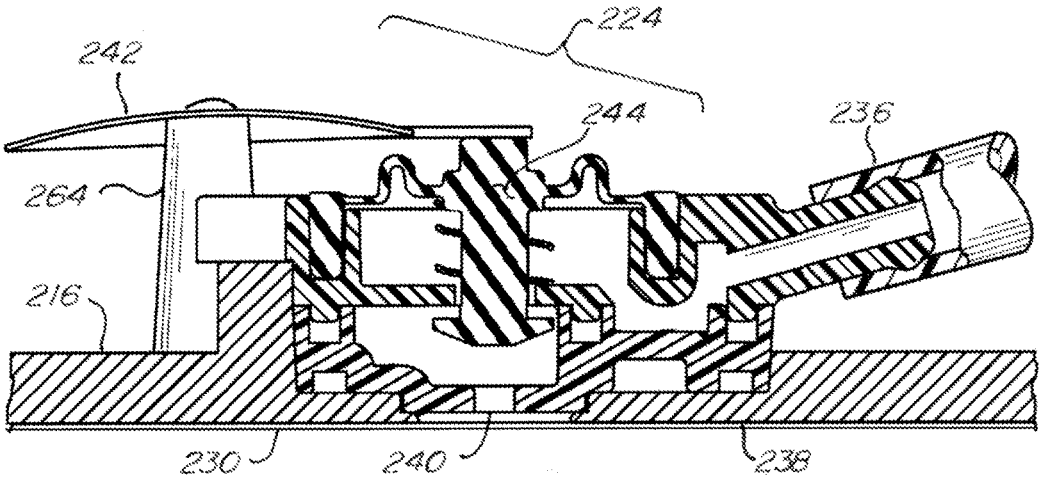
FIG. 11 shows a cross section of the thermal valve of the second embodiment in the opened position
Figure 12:
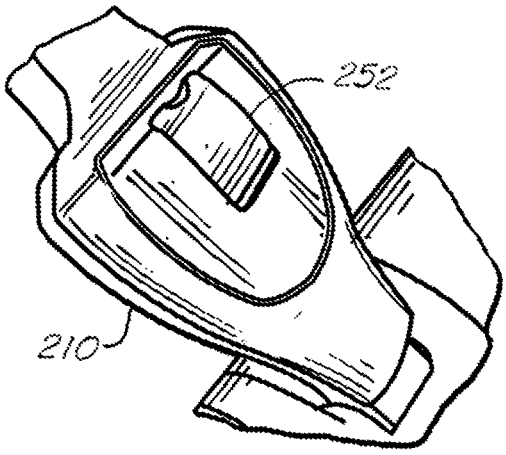
FIG. 12 shows the tank opening of the second embodiment in the closed position.

The thermal valve 224 is shown in cross section FIGS. 10 and 11. FIG. 10 shows the valve in its closed state and FIG. 11 shows it in its open state. The valve includes a bimetal "oilcan" element 242 which reverses shape form concave (FIG. 10) to convex (FIG. 11), when it is heated. This change in shape causes valve stem 244 to be depressed, opening a channel through the valve for the flow of water from the conduit tubing 236 to the channel 238.

Figure 18:
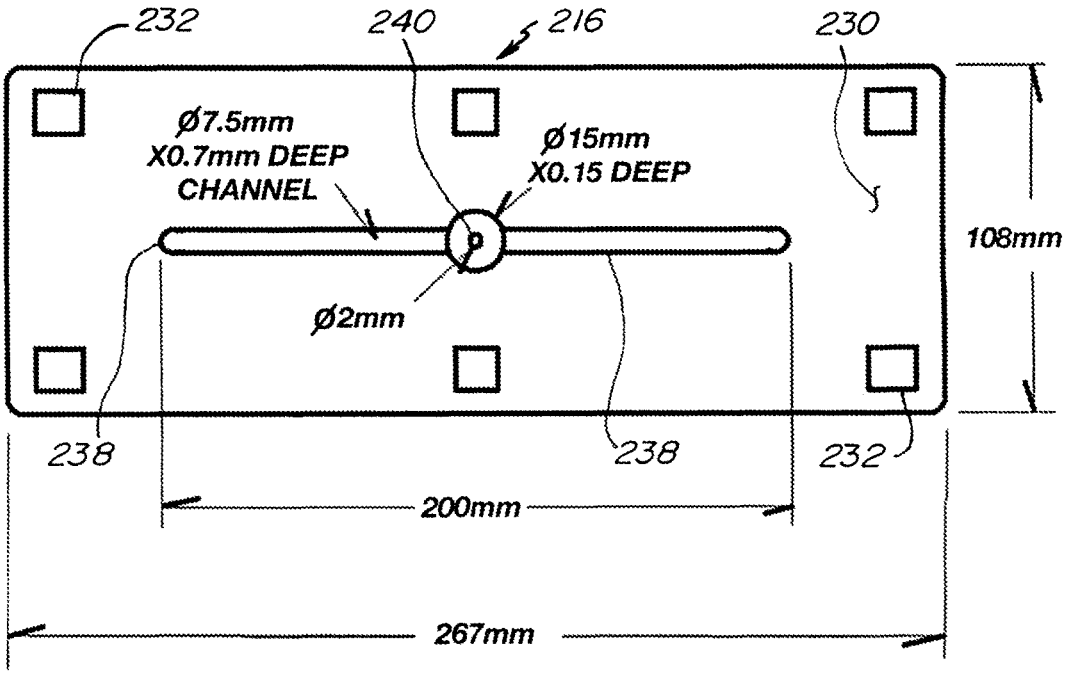
FIG. 18 is an underside view of the heating plate of the second embodiment.

FIG. 18 is a view of the underside of the heating plate 216 where channel 238 can best be seen. In the exemplary embodiment, the planar underside 230 of the heating plate has a length of 267 mm and a width of 108 mm. Channel 238 has a diameter of 7.5 mm and a depth of 0.7 mm into the underside, which is found to be ideal for supplying moisture evenly across the cleaning pad. Hole 240 of the thermal valve is 2 mm in diameter, which is found to be ideally sized for supplying water to the channel at a rate equivalent to rate that moisture is lost from the cleaning plate during use.

Figure 13:
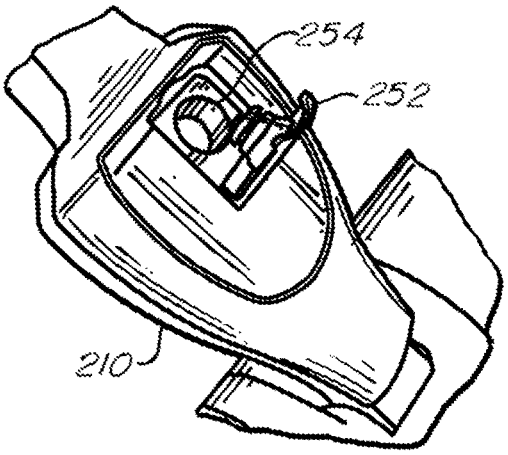
FIG. 13 shows the tank opening of the second embodiment in the opened position.
Figure 14:
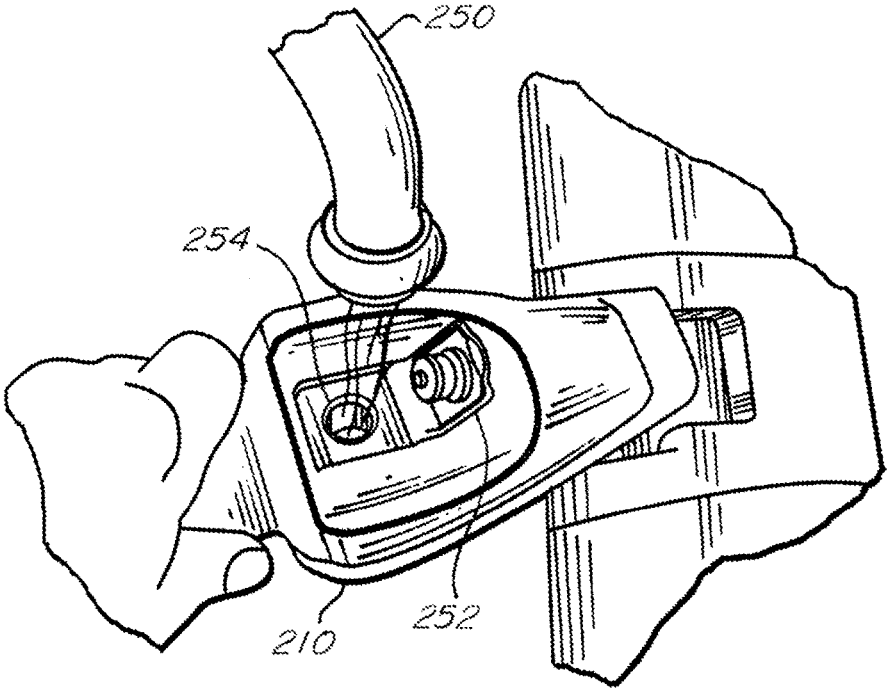
FIG. 14 shows the tank opening of the second embodiment during filling.

FIGS. 13 through 14 show how the water reservoir 210 is filled, such as at spigot 250. Cap 252 is first opened exposing fill hole 254. Water from the spigot it poured through the hole to fill the reservoir, and then cap is closed to seal the reservoir.

Figure 15:
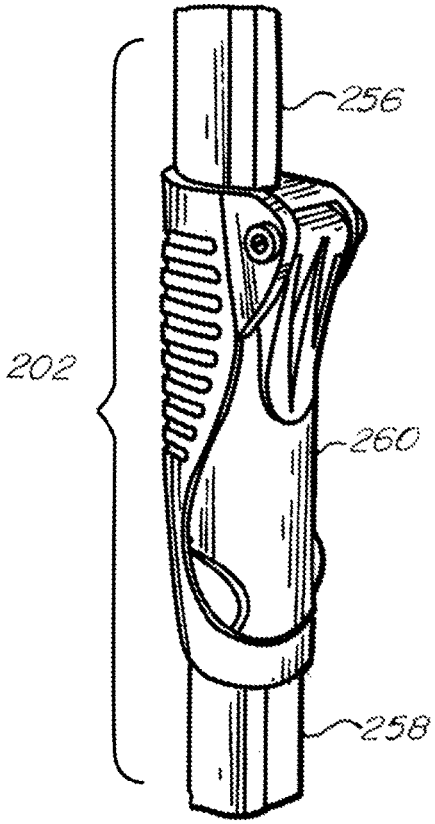
FIG. 15 shows the pole locking mechanism of the second embodiment in the locked position.
Figure 16:
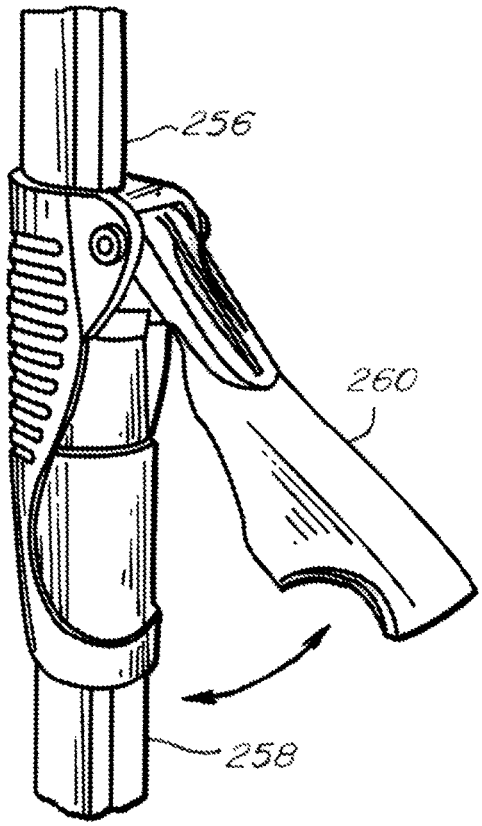
FIG. 16 shows the pole locking mechanism of the second embodiment in the unlocked position.
Figure 17:
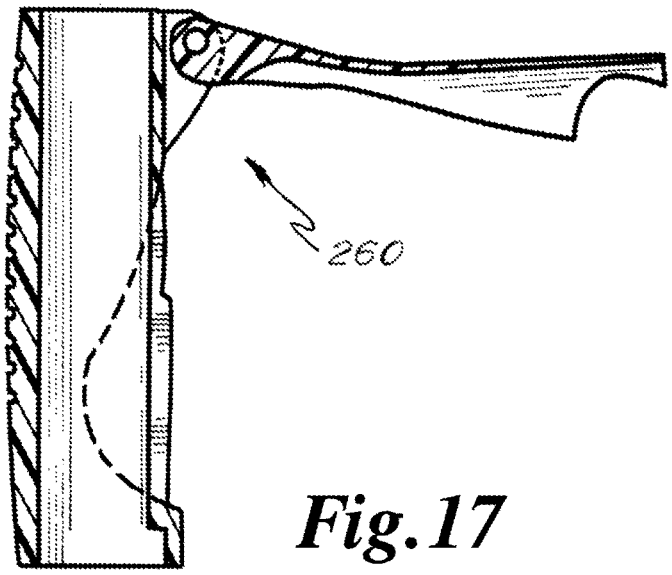
FIG. 17 is a cross section of the pole locking mechanism of the second embodiment.

FIGS. 15 through 17 show how the elongate body 202 is adjustable to allow the user to alter the length of the apparatus. The elongate body includes a smaller diameter upper pole 256 and a larger diameter lower pole 258 to which is affixed a cam locking assembly 260. The locking assembly has a locked configuration (FIG. 15) in which is rigidly secures the upper pole to the lower pole, and an unlocked configuration (FIG. 16) in which it releases the upper pole to allow it to slide freely within the lower pole to a shorter or longer arrangement, according to the comfort of the user. Once the desired length is achieved, the assembly is re-locked to secure the two poles together at that length.

When initially energized, the water-filled apparatus begins a continuously cyclic electrical and fluid operation. Initially, cool water is held within the reservoir and within the conduit tubing and prevented from the channel by the closed thermal valve. The heating element is then energized. Because the bimetal element is rigidly fixed to a post 264 which is cast integrally of the heating plate, it immediately senses the rise in temperature of the planar underside caused by the energized heating element, and once that temperature reaches 85 C, it releases this cool water through hole 240 and channel 238 to moisten the cleaning pad. The thermal conductivity of this moisture speeds up the heating of the cleaning pad and ensures even heating across the pad.

Because the valve is disposed above ("before") the heating plate and because the channel is on the underside of ("after") the heating plate, no water is retained within the heating plate, and scaling, the mineral build-up and other reliability problems normally associated with such water heating is avoided. The heating element remains energized and the moistened cleaning pad continues to be further heated until the thermostat senses that the pad has reached 120 C.

The moisture within the cleaning pad is heated to 100 C, but cannot rise above that temperature as long as water continues to be fed through the channel. If continuously used, the water in the reservoir will continue to flow and will eventually run out. This will cause the cleaning pad to dry and the temperature of the planar underside to rise, which, once reaching 120 C, will open the thermostat and prevent further heating. Alternatively, if the heating element is manually de-energized prior to the emptying of the reservoir, such as by unplugging the power cord or opening a power switch, the temperature sensed by the bimetal valve will drop and cause the valve to close, thereby preventing unwanted leakage from the reservoir during non-use.

In actual use, it is found that the thermal valve and thermostat cycle open and closed repeatedly during use to feed moisture to the pad, heat the moisture, and repeat. At no time is the water heated to steam, and there is no spitting or spraying. The hole of the thermal valve and the channel found to remain clean and clear after extended usage.

The moistening of the pad is found to improve the interaction between the apparatus and the floor and reduce the effort required by the user. For instance, the mop is found to glide more smoothly over the floor as a result of its moist condition. And the lack of steam avoids the damage to hardwood floors and such. Because the pad is maintained in a hot and moist state, it leaves no puddles on the floor. The 100 C temperature and moisture is found ideal for loosening debris and dried foods without the adverse effects of steam-cleaning In alternative versions, the power cord may include an in-line power switch. The power cord may be detachable so that they user may use the apparatus for powerless cold mopping. Other anticipated alternatives include the absence of a water tank, thermal valve, and moistening channel in a version intended to be used with pre-moistened disposable cleaning pads. Still another anticipated alternative includes powering the device by disposable or rechargeable batteries. And still another anticipated alternative includes heating the heating plate by induction rather than by an embedded heating element. In this alternative, an external induction generator could include a bath for dipping the apparatus to wet the pad, and a charging area. The apparatus could thus be absent any power cord or batteries. The cleaning pad would be heated after it was wetted by placing the metallic heating pad adjacent the charging area, within the field of an induction coil in the generator, for a short period of time. The heating pad would stay hot and moist for a short while, then the wetting and heating steps would be repeated.

While the invention has been shown and described with reference to specific exemplary embodiments, it should be understood by those skilled in the art that various changes in form and detail may be made without departing from the spirit and scope of the invention, and that the invention should therefore only be limited according to the following claims, including all equivalent interpretation to which they are entitled.

We claim:

1. An apparatus for the hot and moist cleaning of surfaces, comprising:

a water reservoir, and a cleaning head having a heating plate and a cleaning pad; wherein the heating plate forms a planar underside of the cleaning head and includes a heating element to heat the planar underside;

the water reservoir is adapted to moisten the cleaning pad when the planar underside is above approximately 85 C;

the cleaning pad is removably attached against and in thermal communication with the planar underside such that the cleaning pad is moistened and heated to a temperature between 85 C and 100 C, inclusive; and the heating plate does not substantially heat water from the water reservoir prior to the moistening of the cleaning pad.

2. The apparatus of claim 1 further comprising a thermally-actuated valve to control the moistening of the cleaning pad by the water reservoir.

3. The apparatus of claim 2 wherein the thermally actuated valve is configured to open at approximately 85 C or above to allow water from the water reservoir to the cleaning pad.

4. The apparatus of claim 3 wherein the thermally actuated valve comprises:

a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly.

5. The apparatus of claim 4 further comprising further comprising an elongate body comprising a handle at a proximal end thereof, wherein the cleaning head is flexibly disposed at a distal end of the elongate body.

6. The apparatus of claim 5 wherein the water reservoir is disposed on the elongate body above the cleaning head, and is adapted to moisten the cleaning pad by gravitational force when the valve stem is in the open position.

7. The apparatus of claim 6 further comprising a thermostat electrically connected to the heating element and adapted for sensing the temperature of the planar underside to maintain the temperature of the cleaning pad between 85 C and 100 C, inclusive.

8. The apparatus of claim 7 further comprising a thermofuse electrically connected to the heating element and adapted for sensing the temperature of the planar underside to disable the apparatus when an abnormally high temperature is sensed.

9. An apparatus for the hot and moist cleaning of floors, comprising:

an elongate body comprising a handle at a proximal end thereof and a water reservoir; and a cleaning head flexibly disposed at a distal end of the elongate body and having a heating plate and a cleaning pad; wherein the heating plate forms a planar underside of the cleaning head and includes a heating element to heat the planar underside;

the water reservoir is adapted to moisten the cleaning pad when the planar underside is above 85 C;

the cleaning pad is removably attached against and in thermal communication with the planar underside such that the cleaning pad is moistened and heated to a temperature between 85 C and 100 C, inclusive; and the heating plate does not substantially heat water from the water reservoir prior to the moistening of the cleaning pad.

10. The apparatus of claim 9 further comprising a thermally-actuated valve to control the moistening of the cleaning pad by the water reservoir.

11. The apparatus of claim 10 wherein the thermally actuated valve is configured to open at approximately 85 C or above to allow water from the water reservoir to the cleaning pad.

12. The apparatus of claim 11 wherein the thermally actuated valve comprises:

a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly.

13. The apparatus of claim 12 wherein the water reservoir is disposed on the elongate body above the cleaning head, and is adapted to moisten the cleaning pad by gravitational force when the valve stem is in the open position.

14. The apparatus of claim 13 further comprising a thermostat electrically connected to the heating element and adapted for sensing the temperature of the planar underside to maintain the temperature of the cleaning pad between 85 C and 100 C, inclusive.

15. The apparatus of claim 14 further comprising a thermo-fuse electrically connected to the heating element and adapted for sensing the temperature of the planar underside to disable the apparatus when an abnormally high temperature is sensed.

16. The apparatus of claim 15 further comprising a trigger-actuated valve in fluid communication with the water reservoir and thermally-actuated valve to selectively allow or deny water from the water reservoir to the thermally-actuated valve.

* * * * *